US009849467B2

(12) United States Patent
Hagqvist

(10) Patent No.: US 9,849,467 B2
(45) Date of Patent: Dec. 26, 2017

(54) DISC PACKAGE FOR A CENTRIFUGAL SEPARATOR

(71) Applicant: ALFA LAVAL CORPORATE AB, Lund (SE)

(72) Inventor: Peter Hagqvist, Stockholm (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 14/401,075

(22) PCT Filed: May 13, 2013

(86) PCT No.: PCT/EP2013/059815
§ 371 (c)(1),
(2) Date: Nov. 13, 2014

(87) PCT Pub. No.: WO2013/171160
PCT Pub. Date: Nov. 21, 2013

(65) Prior Publication Data

US 2015/0126353 A1 May 7, 2015

(30) Foreign Application Priority Data

May 14, 2012 (EP) ..... 12167858

(51) Int. Cl.
*B04B 1/08* (2006.01)
*B04B 7/14* (2006.01)

(52) U.S. Cl.
CPC . *B04B 7/14* (2013.01); *B04B 1/08* (2013.01)

(58) Field of Classification Search
CPC ..... B04B 1/08; B04B 7/14
USPC ..... 494/64, 67–73
See application file for complete search history.

(56) References Cited

U.S. PATENT DOCUMENTS 1,760,071 A * 5/1930 Koepke ..... B04B 1/08 494/67
2,091,592 A 8/1937 Henrard
2,261,724 A * 11/1941 Holm ..... C10G 73/28 196/46

(Continued)

FOREIGN PATENT DOCUMENTS

CN 101884957 A 11/2010
CN 102227265 A 10/2011

(Continued)

*Primary Examiner* — Charles Cooley
(74) *Attorney, Agent, or Firm* — Birch, Stewart, Kolasch & Birch, LLP

(57) ABSTRACT

The invention relates to a disc package for a centrifugal separator and a centrifugal separator provided with a disc package comprising a first set of separation discs and a second set of separation discs. Each separation disc of the first and second sets are provided with a separation surface with is inclined with respect to the radial direction. The separation discs of the first and second sets are arranged coaxially around an axis of rotation at a distance from each other such that to form passages between each two adjacent separation discs. The separation discs of the first set have outer diameters A or below, and the separation discs of the second set have outer diameters B or above, wherein diameter B is larger than diameter A. At least two separation discs of the first set is arranged between every two separation disc of the second set.

20 Claims, 2 Drawing Sheets

(56) References Cited

U.S. PATENT DOCUMENTS

| | | | | | |
|---|---|---|---|---|---|
| 2,305,469 | A | | 12/1942 | Forsberg | |
| 2,403,089 | A | * | 7/1946 | Ernest | B04B 1/04 494/42 |
| 2,599,619 | A | * | 6/1952 | Eckers | B04B 1/00 127/67 |
| 2,622,796 | A | * | 12/1952 | Steinacker | B04B 5/06 494/10 |
| 2,665,843 | A | | 1/1954 | Staaff | |
| 2,715,994 | A | * | 8/1955 | Steinacker | B04B 5/06 494/22 |
| 2,731,331 | A | * | 1/1956 | Strezynski | B04B 5/06 422/259 |
| 2,787,413 | A | | 4/1957 | Thylefors | |
| 3,117,928 | A | * | 1/1964 | Thylefors | B04B 1/18 494/27 |
| 3,279,689 | A | * | 10/1966 | Honeychurch | B04B 1/08 494/27 |
| 3,328,282 | A | * | 6/1967 | Keith, Jr. | B04B 1/08 208/28 |
| 3,335,946 | A | * | 8/1967 | Putterlik | B04B 7/14 494/73 |
| 3,484,040 | A | * | 12/1969 | Honeychurch | B04B 1/08 494/27 |
| 3,529,767 | A | * | 9/1970 | Keith, Jr. | B04B 1/08 494/27 |
| 3,534,903 | A | * | 10/1970 | Keith, Jr. | B04B 1/08 494/22 |
| 4,427,407 | A | * | 1/1984 | Paschedag | B04B 7/12 494/70 |
| 4,721,505 | A | * | 1/1988 | Inge | B04B 1/08 494/74 |
| 5,851,396 | A | * | 12/1998 | Saget | B04B 5/12 209/715 |
| 5,921,909 | A | * | 7/1999 | Gustafsson | B04B 1/08 494/70 |
| 7,410,457 | B2 | * | 8/2008 | Heinrich | B04B 1/08 494/70 |
| 8,678,989 | B2 | | 3/2014 | Rudman et al. | |
| 9,687,858 | B2 | * | 6/2017 | Quiter | B04B 1/08 |
| 9,731,300 | B2 | * | 8/2017 | Konigsson | B04B 1/08 |
| 2008/0015099 | A1 | * | 1/2008 | Heinrich | B04B 1/08 494/68 |
| 2011/0212821 | A1 | * | 9/2011 | Mackel | B04B 1/08 494/68 |
| 2011/0237417 | A1 | * | 9/2011 | Rudman | B04B 7/14 494/70 |
| 2015/0119225 | A1 | * | 4/2015 | Inge | B04B 5/12 494/70 |
| 2015/0126353 | A1 | * | 5/2015 | Hagqvist | B04B 7/14 494/72 |
| 2015/0283558 | A1 | * | 10/2015 | Konigsson | B04B 7/14 494/74 |

FOREIGN PATENT DOCUMENTS

| | | | | | |
|---|---|---|---|---|---|
| DE | 557376 | | | 8/1932 | |
| DE | 2545754 | B2 | | 7/1979 | |
| EP | 1661626 | B1 | | 2/2009 | |
| GB | 966353 | | | 8/1964 | |
| GB | 1207500 | A | * | 10/1970 | B04B 1/08 |
| JP | 28-4883 | | | 6/1953 | |
| JP | 39-26606 | | | 11/1964 | |
| JP | 57-119859 | A | | 7/1982 | |
| JP | 11-506383 | A | | 6/1999 | |
| JP | 2009-532204 | A | | 9/2009 | |
| SE | 20595 | C1 | | 1/1904 | |
| SE | 42636 | C1 | | 2/1914 | |
| SE | 70651 | C1 | | 11/1927 | |
| SE | 115167 | C1 | | 10/1945 | |
| SE | 135654 | C1 | | 5/1952 | |
| SE | 179611 | C1 | | 6/1962 | |
| SE | 186436 | C1 | | 11/1963 | |
| SE | 22981 | | | 8/1964 | |
| SE | 227 107 | | | 7/1969 | |
| SE | 504094 | C3 | | 11/1996 | |
| WO | WO 96/27445 | A1 | | 9/1996 | |
| WO | WO 2007/11476 | A1 | | 10/2007 | |
| WO | WO 2010/125049 | A1 | | 11/2010 | |

* cited by examiner

DISC PACKAGE FOR A CENTRIFUGAL SEPARATOR

BACKGROUND

The invention relates to a disc package for a centrifugal separator comprising a plurality of separation discs, each provided with a separation surface with is inclined with respect to the radial direction and wherein the separation discs are arranged coaxially around an axis of rotation at a distance from each other such that to form passages between each two adjacent separation discs. The invention also relates to a centrifugal separator comprising such a disc package.

From the early days of development of centrifugal separators it is known to provide each separation disc in a disc package with a brim extending radially outside the frustoconical portion of the disc, in order to improve the mechanical stability of the discs, see e.g. SE 22981.

A disc stack having a single separation disc provided with a brim extending radially outside the rest of the separation discs of a disc stack is also previously known, see SE 227107. This is used to divide the disc stack into a first section where the cleaning of the light phase is optimised (purifier mode of operation) and a second section where the cleaning of the heavy phase is optimised (concentrator mode of operation).

SUMMARY

It is an object of the invention to improve the separation efficiency of the centrifugal separator. In particular it is an object to minimise the risk of separated particles being recirculated into the separating passages in-between the separation discs of the disc package. None of the documents cited above provides a satisfactory solution to this.

Thus the invention relates to a disc package for a centrifugal separator, comprising a first set of separation discs and a second set of separation discs. Each separation disc of the first and second sets is provided with a separation portion having a separation surface with is inclined with respect to the radial direction. The separation surfaces may be a frustoconical portion of the separation discs. The angle of inclination of the separation surface may be within the range of 30-50 degrees, preferably about 40 degrees, to the radial direction.

The separation discs of the first and second sets are arranged coaxially around an axis of rotation at a distance from each other such that to form passages between each two adjacent separation discs. The separation discs are preferably arranged such that the base portions of the inclined separation portions of the separation discs in the disc package are facing in the same direction. The separation discs in the disc package may be arranged such that the fluid to be separated flows radially inwards in the passages between each two adjacent separation discs of any of the two sets.

The separation discs of the first set have outer diameters A or below, the separation discs of the second set have outer diameters B or above, and the diameter B is larger than diameter A. At least two separation discs of the first set are arranged between every two separation disc of the second set.

As an effect of this the risk of formation of currents in the separation space in the region immediately outside the disc package is minimised. Such currents having an axial flow component may have the undesired effect to bring along particles already separated from a liquid mixture of components. The risk of separated particles being recirculated into the separating passages of the disc package is thus minimised and the separation efficiency of the centrifugal separator increased. The disc package is also easy to fabricate and assemble.

The outer diameters of the separation discs of the first set may vary as long as they have an outer diameter of A or below. Alternatively the separation discs of the first set have an outer diameter A. Similarly, the outer diameters of the separation discs of the second set may vary as long as they have an outer diameter of B or above. Alternatively every separation disc of the second set may have an outer diameter B.

The diameter B may be 3-15%, preferably 5-12% larger than diameter A, or the diameter B may be 14-50 mm, preferably 20-30 mm larger than diameter A. Thus the risk of separated particles being recirculated into the separating passages of the disc package is minimised while maintaining an open space for separation radially outside the disc package.

The separation discs of the first and second set may extend from a common inner radial position. The radial extent and inclination of the inclined separation portion may be similar over the separation discs of the two sets and over the disc package as a whole.

The separation discs of the second set may have a brim portion formed radially outside the diameter A, which brim portion has an inclination to the radial direction which is different from the inclination at the separation portion. The radial extent of the brim portion may be 1.5-7.5%, preferably 2.5-6% of diameter A, or the radial extent of the brim portion may be 7-25 mm, preferably 10-15 mm. The radial extent of the inclined separation surface may be similar for the separation discs in the first and second set.

The angle of the brim portion to the radial direction may be less than 45 degrees, preferably less than 30 degrees, more preferably less than 15 degrees, most preferably zero degrees. If the angle is close to zero or zero, i.e. the brim portion is in a plane perpendicular to the axis of rotation, the brim portion acts to define a flow zone radially outside the separation discs of the first set without acting as a separation surface. Thus the inclined separation surface of each separation disc of the second set may extend to the diameter A. The angle of the brim portion may be the same or may vary over the separation discs of the second set in the disc package.

The brim portion may be ring shaped and the surface of the brim portion may be plain and formed as a continuous sheet of material circumventing the separation surface, thereby being provided essentially without any apertures or protrusions. Thus the amount of turbulence caused by the brim portion is minimised.

There may be 2-10, preferably 3-5 separation discs of the first set arranged between every two separation disc of the second set. This configuration provides a particularly advantageous flow formation in the flow zone radially outside the separation discs. The total number of separation discs of the second set to the total number of separation discs in the disc package may be below 30%, preferably below 25%, and above 5%, preferably above 10%. More preferably the total number of separation discs of the second set to the total number of separation discs in the disc package is within the range of 12-20%.

A lower portion of the disc package, at the end of the package in the direction of the base of the separation surface of the separation discs (i.e. in the axially diverging direction of the separation surface of the separation discs), may be provided only with separation discs of the first set. The lower portion of the disc package may be at least 20%, preferably at least 25%, more preferably at least 30% of the disc package. In a disc package having 82 discs this lower portion may thus contain 18-26 discs. Similarly, an upper portion of the disc package, at the end of the package in the direction of the top of the separation surface of the separation discs (i.e. in the axially converging direction of the separation surface of the separation discs), may be provided only with separation discs of the first set. The upper portion of the disc package may be at least 15%, preferably at least 20%, more preferably at least 25% of the disc package. In a disc package having 82 discs this upper portion may thus contain 12-21 discs. Thus the risk of separated particles being recirculated into the separating passages of the disc package is minimised while maintaining a desired flow in the portions of the axial ends of the disc package.

The inclined separation surface of each separation disc of the first set may extend to the outer diameter of the separation disc. Thus the separation discs of the first set may be provided essentially without any brim portion, maximising the separation surface.

Each separation disc may be provided with cut-outs arranged such that to distribute the flow of fluid to be separated through and over the disc stack. The separation discs of the first set may be provided with cut-outs in the form of notches which are cut-outs that are open towards the outer radius of the separation disc. This has the effect that the risk of clogging in the area of the cut outs is minimised. The separation discs of the second set may be provided with cut-outs in the form of apertures that are closed towards the outer radius of the separation disc. This has the effect to improve the mechanical properties of the separation discs of larger diameter, to be able to cope with the centrifugal forces. The combination of cut-outs in the form of notches on the separation discs of the first set and cut-outs in the form of apertures on separation discs of the second set further minimises the risk of clogging in the area of the cut-outs on the separation discs of the second set.

The invention further relates to a centrifugal separator for separating a liquid mixture of components, comprising a rotor enclosing a separation space wherein a disc package as described is arranged. The rotor may comprise outlets from the radially outer portion of the separation space for intermittent discharge of a sludge phase.

The interior wall of the rotor may be provided with a wall portion, which may be conical, and the separation discs of the second set may be arranged in the disc stack such that there is a passage between the outer brim of each disc and the rotor wall portion of at least 1 mm, preferably at least 1.5 mm.

DRAWINGS

DETAILED DESCRIPTION

Figure 1:
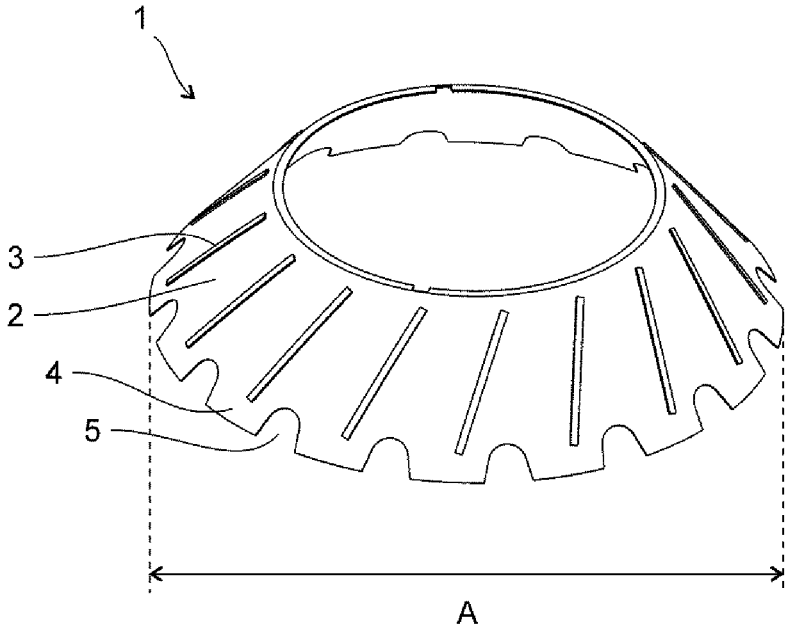
FIG. 1 shows an embodiment of a separation disc of the kind comprised by the first set in the disc package.

In FIG. 1 a separation disc 1 of the kind comprised by the first set in the disc package is shown, having a frustoconical separation portion 2 with an inner and an outer separation surface. The separation portion is provided with a plurality of distance members in the form of elongated caulks 3 providing distances to form passages between each two adjacent separation discs in a package formed by a stack of separation discs. The caulks are fastened to the outer surface of the frustoconical separation portion of the disc and distributed around the circumference of the disc. The outer diameter A of the separation disc is 165 mm, and the inclined separation surface extend all the way out to this outer diameter. Thus the radially outer portion 4 of the separation disc is part of the inclined separation surface. The disc is provided with a plurality of cut-outs in the form of notches 5 at this radially outer portion 4 of the separation disc having a diameter A, which notches are open towards the outer radius of the separation disc. The number of notches 5 correspond to the number of caulks and the notches are distributed around the circumference of the disc in-between the caulks.

Figure 2:
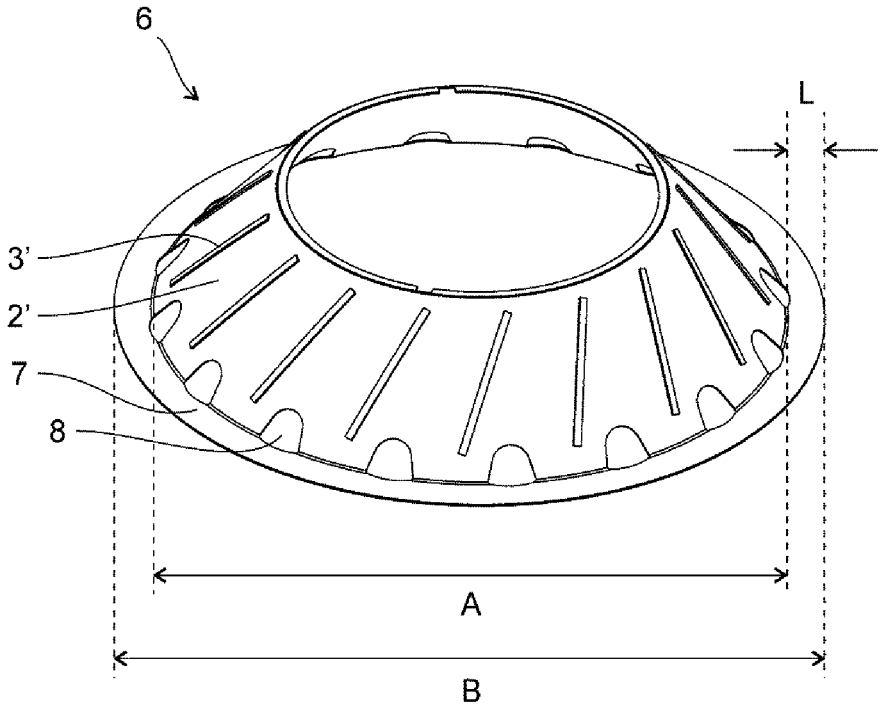
FIG. 2 shows an embodiment of a separation disc of the kind comprised by the second set in the disc package.

In FIG. 2 a separation disc 6 of the kind comprised by the second set in the disc package is shown, having a frustoconical separation portion 2' with an inner and an outer separation surface. The separation portion is provided with a plurality of distance members in the form of elongated caulks 3' providing distances to form passages between each two adjacent separation discs in a package formed by a stack of separation discs. The caulks are fastened to the outer surface of the frustoconical separation portion of the disc and distributed around the circumference of the disc. The separation surface extends to the diameter A and radially outside the separation surface the disc is provided with a flat brim 7 (i.e. having an angle of zero degrees to the radial direction) extending to the outer diameter of the separation disc B. The diameter B is 185 mm and thus the radial extension of the brim is $L=(B-A)/2$, i.e. 10 mm. The diameter B is thus 12% larger than the diameter A. Each disc 6 has a generally circular outer edge at B as seen in, FIG. 2. The disc is provided with a plurality of cut-outs in the form of apertures 8 at the radially outer part of the separation portion, which cut-outs are closed towards the outer radius of the separation disc by means of the brim. The number of apertures 8 correspond to the number of caulks and the apertures are distributed around the circumference of the disc at positions corresponding to the notches of the separation disc 1 in the first set.

Figure 3:
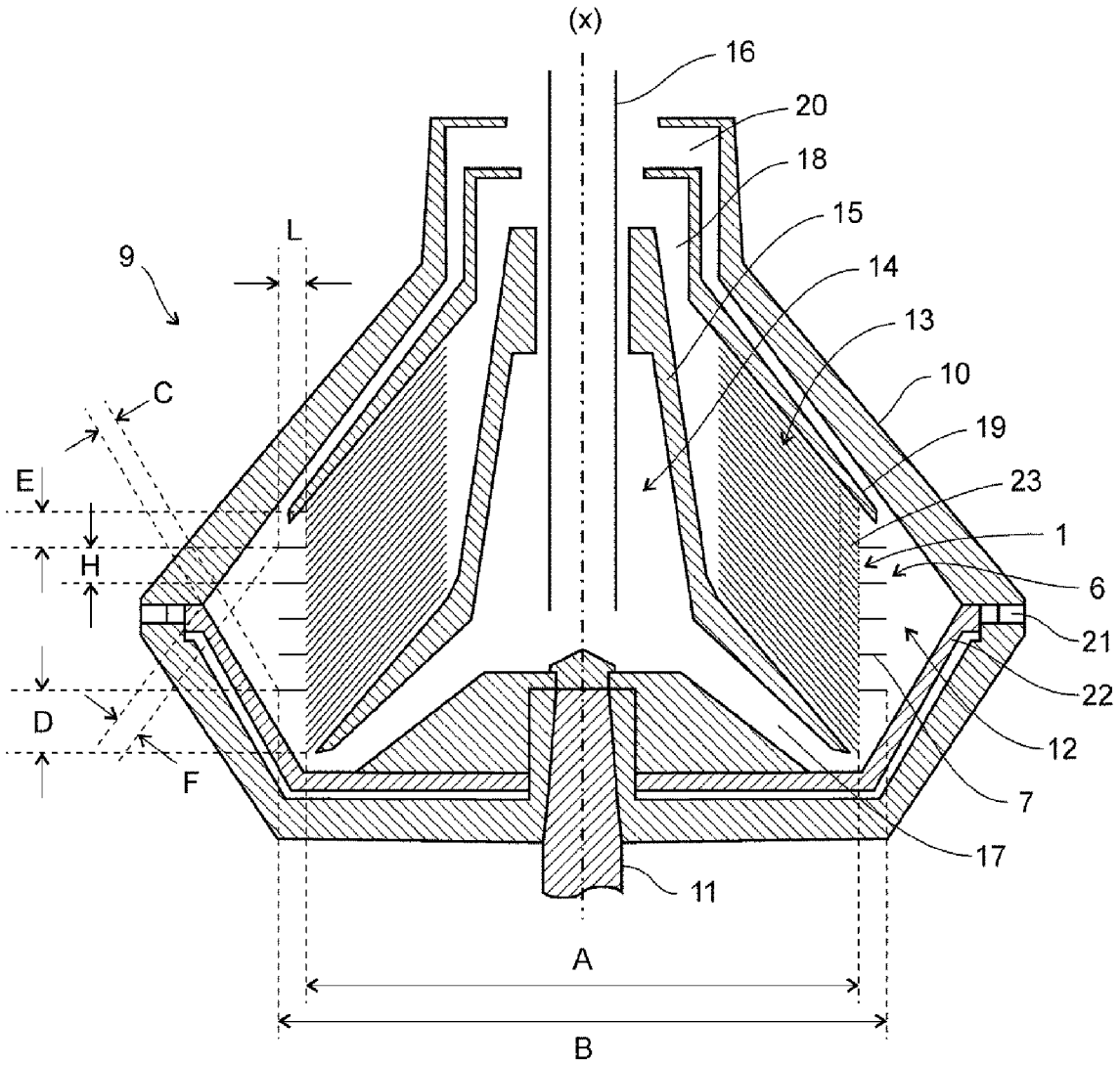
FIG. 3 shows a cross-section of a portion of a centrifugal separator having a disc package comprising a first and a second set of separation discs.

FIG. 3 shows a portion of a centrifugal separator 9 for separation of a liquid mixture of components, the separator having a rotor 10 supported by a spindle 11 (partly shown) which is rotatably arranged in a frame around an axis of rotation (x). The rotor forms within itself a separation chamber 12 wherein a disc package 13 is arranged. The rotor further comprises an inlet chamber 14 formed within a distributor 15 into which a stationary inlet pipe 16 extends for supply of a liquid mixture of components to be separated. The inlet chamber communicates with the separation chamber via passages 17 formed in the rotor. The radially inner portion of the disc package communicates with an outlet 18 for a lighter liquid component of the mixture. The outlet 18 is delimited by a top disc 19 provided at the upper axial end of the disc package 13. The top disc 19 and the upper wall part of the rotor 10 delimits a passage for a denser liquid component of the mixture, the passage extending from the radially outer part of the separation space 12 to an outlet 20 for the a heavier component of the liquid mixture. The rotor is further provided with outlets 21 from the radially outer periphery of the separation space 12 for intermittent discharge of a sludge component of the liquid mixture comprising denser particles forming a sludge phase. The opening of the outlets 21 is controlled by means of an operating slide 22 actuated by operating water, as known in the art.

The disc package 13 comprises a first and a second set of separation discs, the first set comprising separation discs 1 of the kind shown in FIG. 1, and the second set comprising separation discs 6 of the kind shown in FIG. 2, provided with brims 7. The separation discs are arranged coaxially around the axis of rotation (x) at a distance from each other by means of the caulks 3, 3', such that to form passages between each two adjacent separation discs. There are three separation discs of the first set arranged between every two separation disc of the second set. The passages extend from the radially outer portions of the separation discs to the radially inner portions of the separation discs. In the figure the distance between each separation disc is exaggerated and the disc package is schematically shown to have 28 discs. A typical disc package comprises 82-120 discs and a typical distance between the separation discs, generated by the caulks, is 0.4-0.75 mm. Thus the typical distance H between separation discs of the second set in the disc package is 1.6-4.5 mm, preferably 2-4 mm.

The cut-outs in the form of notches on the separation discs 1 in the first set and the cut-outs in the form of apertures on the separation discs 6 in the second set are aligned in the disc package to form distribution channels 23 for the liquid mixture.

A lower portion of the disc package, i.e. at the end of the package in the direction of the base of the separation surface of the separation discs and indicated as D, is provided only with separation discs of the first set. This portion is 25% of the height of the disc package (7 of the 28 separation discs shown), and in a typical disc package this portion is 21-26 of 82 separation discs. The clearance C between the radially outer end of the brim of the first (lower) separation disc of the second set and the interior wall of the rotor is at least 1.5 mm to provide a passage for sludge toward the outlets 21. Similarly, an upper portion of the disc package, i.e. at the end of the package in the direction of the top of the separation surface of the separation discs and indicated as E, is provided only with separation discs of the first set. The clearance F between the radially outer end of the brim of the last (topmost) separation disc of the second set and the interior wall of the rotor is at least 1.5 mm.

An embodiment of a disc package includes, from bottom to top, a lower portion of 21 separation discs of the first set, followed by 12 separation discs of the second set each having three separation discs of the first set in-between (i.e. all in all 11*4+1=45 separation discs), and an upper portion of 16 separation discs of the first set on top. Thus the total number of separation discs of the second set to the total number of separation discs in such a disc package shown is 12/82, which is below 20% but above 10%.

The invention claimed is:

1. A disc package for a centrifugal separator, comprising:

a first set of separation discs;

notches extending inwardly from an outer edge of each of the separation discs in the first set;

a second set of separation discs, each disc thereof having a generally circular outer edge; and apertures spaced from the outer edge of each of the separation discs in the second set, wherein each separation disc of the first and second sets are provided with a separation portion having a surface inclined with respect to the radial direction, wherein the separation discs of the first and second sets are arranged coaxially around an axis of rotation at a distance from each other to form passages between each two adjacent separation discs, wherein the separation discs of the first set have outer diameters A or below, wherein the separation discs of the second set have outer diameters B or above, wherein the diameter B is larger than the diameter A, wherein the notches of the first set are spaced a same distance from the axis of rotation as the apertures of the second set, and wherein at least two separation discs of the first set are arranged between every two separation discs of the second set.

2. The disc package according to claim 1, wherein the diameter B is 3-15% larger than the diameter A, or wherein the diameter B is 14-50 mm larger than the diameter A.

3. The disc package according to claim 1, wherein each separation disc of the second set has a brim portion formed radially outside the diameter A, and the brim portion has an inclination to the radial direction different from the inclination of the separation surface.

4. The disc package according to claim 3, wherein the angle of the brim portion to the radial direction is less than 45 degrees.

5. The disc package according to claim 3, wherein the angle of the brim portion to the radial direction is less than 30 degrees.

6. The disc package according to claim 3, wherein the angle of the brim portion to the radial direction is less than 15 degrees.

7. The disc package according to claim 3, wherein the angle of the brim portion to the radial direction is zero degrees.

8. The disc package according to claim 1, wherein 3-5 separation discs of the first set are arranged between every two separation discs of the second set.

9. The disc package according to claim 1, wherein a lower portion of the disc package, at an end of the disc package in a direction of a base of the separation surface of the separation discs, is provided only with separation discs of the first set.

10. The disc package according to claim 9, wherein the lower portion of the disc package is at least 20% of the disc package.

11. The disc package according to claim 9, wherein the lower portion of the disc package is at least 25% of the disc package.

12. The disc package according to claim 1, wherein an upper portion of the disc package, at an end of the disc package in a direction of a top of the separation surface of the separation discs, is provided only with separation discs of the first set.

13. The disc package according to claim 12, wherein the upper portion of the disc package is at least 15% of the disc package.

14. The disc package according to claim 1, wherein the number of separation discs of the second set in the disc package is less than 30% of the total number of separation discs in the disc package.

15. The disc package according to claim 1, wherein the inclined separation surface of each separation disc of the first set extends to the outer diameter of the separation disc.

16. A centrifugal separator comprising a rotor enclosing a separation space wherein the disc package according to claim 1 is arranged.

17. The disc package according to claim 1, wherein the diameter B is 5-12% larger than the diameter A, or wherein the diameter B is 20-30 mm larger than the diameter A.

18. A disc package for a centrifugal separator, comprising:

a first set of separation discs; and a second set of separation discs each disc thereof having a generally circular outer edge, wherein each separation disc of the first and second sets are provided with a separation portion having a surface inclined with respect to the radial direction, wherein the separation discs of the first and second sets are arranged coaxially around an axis of rotation at a distance from each other to form passages between each two adjacent separation discs, wherein the separation discs of the first set have outer diameters A, the outer diameter A being formed by an outer edge of the separation portion having a surface inclined with respect to the radial direction, wherein the separation discs of the second set have outer diameters B, wherein each separation disc of the second set has a brim portion having an inner diameter A, the brim portion having an inclination to the radial direction different from the inclination of the separation surface, wherein the diameter B is larger than the diameter A, wherein at least two separation discs of the first set are arranged between every two separation discs of the second set, notches extending inwardly from an outer edge of each of the separation discs in the first set; and apertures spaced from the outer edge of each of the separation discs in the second set, wherein the notches of the first set are spaced a same distance from the axis of rotation as the apertures of the second set.

19. A centrifugal separator, comprising a rotor, the rotor having a single separation chamber, a first set of separation discs in the single separation chamber;

notches extending inwardly from an outer edge of each of the separation discs in the first set;

a second set of separation discs in the single separation chamber, each disc thereof having a generally circular outer edge; and apertures spaced from the outer edge of each of the separation discs in the second set, wherein each separation disc of the first and second sets are provided with a separation portion having a surface inclined with respect to the radial direction, wherein the separation discs of the first and second sets are arranged coaxially around an axis of rotation at a distance from each other to form passages between each two adjacent separation discs, wherein the separation discs of the first set have outer diameters A or below, wherein the separation discs of the second set have outer diameters B or above, wherein the diameter B is larger than the diameter A, wherein the notches of the first set are spaced a same distance from the axis of rotation as the apertures of the second set, and wherein at least two separation discs of the first set are arranged between every two separation discs of the second set.

20. The centrifugal separator according to claim 19, wherein 3-5 separation discs of the first set are arranged between every two separation discs of the second set.

* * * * *